United States Patent [19]

Alcantara Perez et al.

[11] Patent Number: 4,762,040

[45] Date of Patent: Aug. 9, 1988

[54] BLADE SHARPENING AND GUIDE MECHANISM

[75] Inventors: Bernardo Alcantara Perez; Rodrigo Becerra Carrasco; Mario Andrada Galan, all of Madrid, Spain

[73] Assignee: Investronica, S.A., Madrid, Spain

[21] Appl. No.: 38,360

[22] Filed: Apr. 14, 1987

[30] Foreign Application Priority Data

Apr. 16, 1986 [ES] Spain ..... 554.047

[51] Int. Cl.[4] ..... B26D 7/12

[52] U.S. Cl. ..... 83/56; 51/247; 51/327; 83/71; 83/174; 83/925 CC

[58] Field of Search ..... 83/174, 174.1, 56, 13, 83/71, 925 CC; 51/247, 327

[56] References Cited

U.S. PATENT DOCUMENTS

| | | | |
|---|---|---|---|
| 3,507,177 | 4/1970 | Baldwin | 83/174 |
| 3,511,124 | 5/1970 | Bruns | 83/522 |
| 3,548,699 | 12/1970 | Gerber et al. | 83/528 |
| 3,715,945 | 2/1973 | Mochizuki et al. | 83/71 |
| 3,764,775 | 10/1973 | Hasslinger et al. | 83/208 X |
| 3,776,072 | 12/1973 | Gerber et al. | 83/34 |
| 3,784,183 | 1/1974 | Castro et al. | 269/20 |
| 3,955,458 | 5/1976 | Pearl | 83/458 |
| 4,033,214 | 7/1977 | Pearl | 83/174 |
| 4,070,936 | 1/1978 | Duncan | 83/12 |
| 4,133,233 | 1/1979 | Pearl | 83/174 X |
| 4,294,047 | 10/1981 | Pearl | 51/327 |
| 4,322,993 | 4/1982 | Stumpf | 83/422 |
| 4,345,496 | 8/1982 | Pearl | 83/100 |
| 4,373,412 | 2/1983 | Gerber et al. | 83/24 |
| 4,391,170 | 7/1983 | Boverman et al. | 83/71 |
| 4,393,296 | 7/1983 | Dompas | 219/121 PC |
| 4,401,001 | 8/1983 | Gerber et al. | 83/451 |
| 4,434,691 | 3/1984 | LeBlond | 83/56 |
| 4,542,672 | 9/1985 | Pearl | 83/409 |
| 4,553,016 | 11/1985 | Kunii et al. | 83/370 X |
| 4,554,824 | 10/1985 | Knutsson | 83/152 X |
| 4,596,171 | 6/1986 | Gerber | 83/56 |

FOREIGN PATENT DOCUMENTS

| | | |
|---|---|---|
| 2614347 | 7/1977 | Fed. Rep. of Germany . |
| 2817674 | 10/1978 | Fed. Rep. of Germany . |
| 406103 | 7/1966 | Switzerland . |

*Primary Examiner*—Frank T. Yost

*Attorney, Agent, or Firm*—Wenderoth, Lind & Ponack

[57] ABSTRACT

A method and an apparatus for sharpening a cutting blade of a numerically controlled cutting apparatus which includes a conveyor for supporting material to be cut and a cutting head assembly mounted on a carriage disposed above a cutting surface of the conveyor. The cutting head assembly includes a cutting blade, a mechanism for rotating the cutting blade about an axis perpendicular to the cutting surface, a mechanism for raising and lowering the cutting blade and a pair of grinding wheels for sharpening the cutting blade. The rotating mechanism rotates the cutting blade from a first angular position at which cutting is performed to a second angular position at which the pair of grinding wheels sharpen the cutting blade. The pair of grinding wheels are mounted on a grinder support which is pivotally supported on a rotatable shaft such that the grinding wheels are driven and the grinder support is biased to bring one of the grinding wheels in contact with one side of the cutting blade when the shaft is rotated in one direction and the other one of the grinding wheels is brought into contact with the other side of the cutting blade when the shaft is rotated in the opposite direction. The grinding operation is automatically carried out by a programmable controller.

20 Claims, 4 Drawing Sheets

BLADE SHARPENING AND GUIDE MECHANISM

BACKGROUND OF THE INVENTION

1. Field of the Invention

The present invention relates to a mechanism and a process for the sharpening of a blade for an automatic cutting machine.

2. Description of the Prior Art

Procedures and automatic machinery for the cutting of laminar materials such as fabric, plastics, etc., are well known at the present time and these devices make use of different types of tools for the cutting operation. In particular, numerically controlled machines are commonly used for cutting laminar materials by means of the reciprocating movement of the cutting blade. The present invention is directed to a machine of this type.

Prior to the present invention, a variety of solutions for guiding and sharpening have been used but each of these solutions has different individual advantages and disadvantages depending on the characteristics of the overall solution adopted for the cutting process, i.e. the type of fabric support surface, the type of blade, the location of all the blade operating mechanisms, the multi-purpose nature of some components, etc.

SUMMARY OF THE INVENTION

An object of the present invention is to provide a mechanism and a process for sharpening the blade of an automatic cutting machine in which a rotating mechanism rotates the blade to a first angular position at which cutting is performed and to a second angular position at which sharpening is performed.

An object of the present invention is to provide a device comprising means for supporting one or more layers of material to be cut on a cutting surface, carriage means disposed above the cutting surface for movement across the cutting surface, a cutting head assembly disposed on the carriage means, the cutting head assembly including a cutting blade and means for raising and lowering the cutting blade with respect to the cutting surface, the cutting head assembly further including means for rotating the cutting blade about an axis perpendicular to the cutting surface and grinding means for sharpening the cutting blade, the rotating means being operable to rotate the cutting blade from a first angular position at which cutting is performed to a second angular position at which the grinding means is operable to sharpen the cutting blade, the first angular position being variable with respect to the axis and the second angular position being fixed with respect to the axis, the grinding means being operable during a sharpening operation to sharpen one side of the cutting blade for a predetermined period of time and then to sharpen the other side of the cutting blade for another predetermined period of time, and programmable controller means for determining when sharpening of the cutting blade is to be performed, the programmable controller means being operatively connected to the raising and lowering means, the rotating means and the grinding means whereby the cutting blade is raised such that a bottom end thereof is spaced from the cutting surface, the cutting blade is rotated from the first angular position to the second angular position prior to the sharpening operation, the grinding means sequentially sharpens each side of the cutting blade, the cutting blade is rotated back to the first angular position and the cutting blade is lowered to begin another cutting operation.

The raising and lowering means comprises a movable member which supports the cutting blade, a stationary member supported by the rotating means and means for moving the movable member with respect to the stationary member. The rotating means comprises a rotatable support rotatably supported on the carriage means and reversible motor means for rotating the rotatable support with respect to the carriage means such that the cutting blade is maintained in the first angular position during a cutting operation and in the second angular position during the sharpening operation.

The grinding means includes a sharpening motor fixedly mounted on the carriage means, grinder support means pivotally mounted on the rotating means, a pair of grinding wheels rotatably supported on the grinder support means, and means for engaging an output shaft of the sharpening motor with the grinder support means and with the grinding wheels such that the grinder support means biases one of the grinding wheels in contact with one side of the cutting blade when the output shaft is rotated in one direction and the grinder support means biases the other one of the grinding wheels in contact with the other side of the cutting blade when the output shaft is rotated in an opposite direction, the engaging means driving the grinding wheels in rotation while biasing the grinder support means.

The engaging means comprises a shaft rotatably supported on the rotation means, the shaft pivotally supporting the grinder support means and biasing the grinder support means when the shaft is rotated. The engaging means further comprises a movable friction wheel rotatably mounted on clutch means for engaging the friction wheel with the output shaft of the sharpening motor and with the shaft supporting the grinder support means, the clutch means being mounted on the carriage means and operable to engage the friction wheel with the output shaft and the shaft only when the cutting blade is in the second angular position.

The engaging means further includes belt means extending between the grinding wheels and the shaft whereby rotation of the shaft effects rotation of the grinding wheels, the belt means comprising a single endless belt extending around a circumferential annular groove in each of the grinding wheels and around spaced apart pulleys disposed on the shaft.

The clutch means comprises an actuator mounted on the carriage means and a lever having one end thereof pivotally mounted on the carriage means, the friction wheel being rotatably mounted on the other end of the lever, and the actuator including an extendible rod connected to the lever for moving the friction wheel into and out of engagement with the output shaft of the sharpening motor and with the shaft supporting the grinder support means when the cutting blade is in the second angular position.

BRIEF DESCRIPTION OF THE DRAWINGS

Objects and features of the present invention will become more apparent from the following description with reference to the accompanying drawings, in which.

DETAILED DESCRIPTION OF THE PREFERRED EMBODIMENTS

Figure 1:
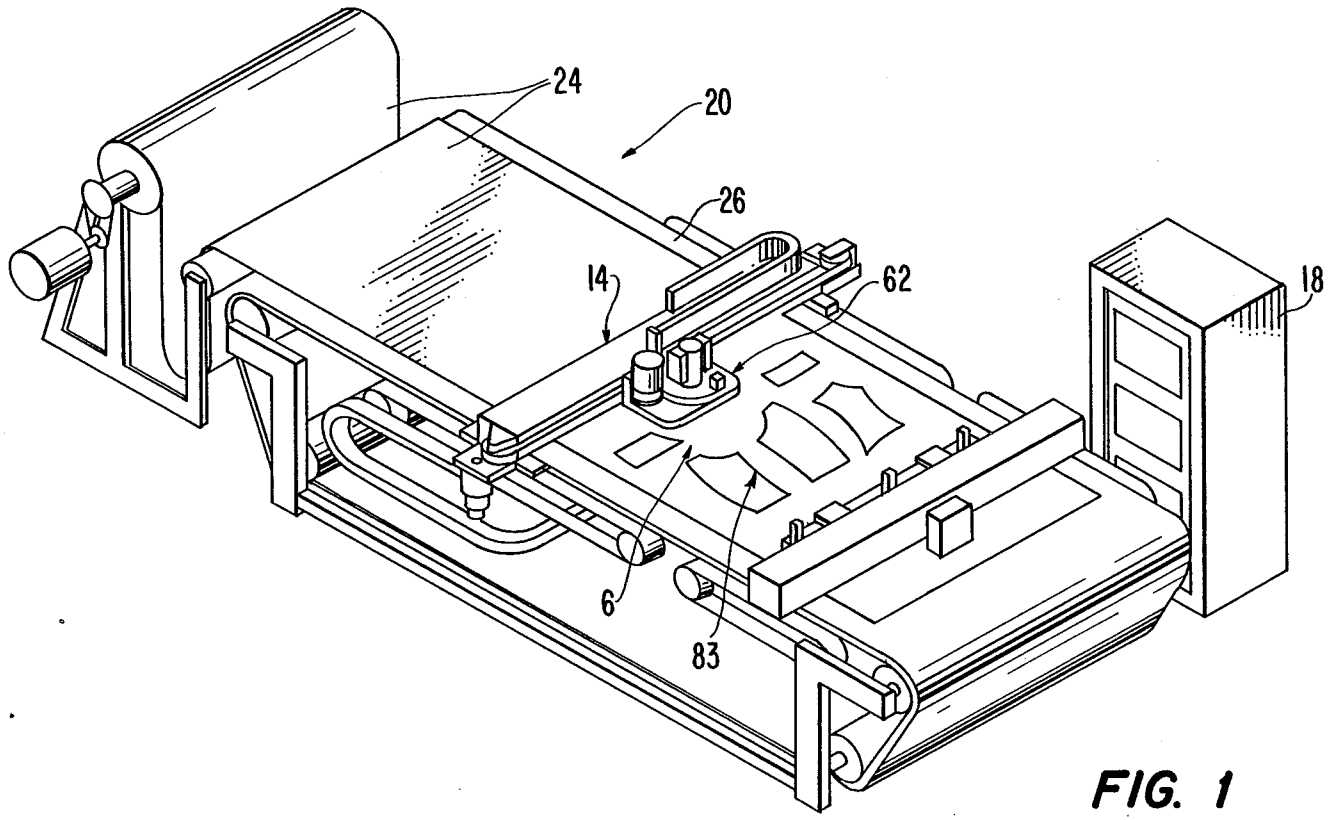
FIG. 1 is a general diagrammatic perspective view of the machine of the present invention.

FIG. 1 shows the cutting apparatus 20 of the present invention in which one or more sheets of material 24 to be cut is fed from a suitable supply means at one end of a cutting table and is passed over a cutting surface 26. A cutting area 6 is provided in which pieces are cut by a cutting tool mounted on a Y carriage which is movably mounted on an X carriage of a carriage assembly 14. The cutting tool is a reciprocating cutting blade 106 which follows a cutting path 83 by combined movement of the cutting blade around an axis perpendicular to the cutting surface 26 and by movement of the X-Y carriage assembly 14 such that the cutting edge of the blade remains tangent to a cutting path 83. Movement of the blade and the X-Y carriage assembly is controlled by a programmable controller or computer 18. The cutting surface is comprised of a type of penetrable brush surface of an endless conveyor mounted on the cutting table. Suitable vacuum means can be provided beneath the table for holding the material 24 to be cut firmly against the conveyor surface.

Figure 2:
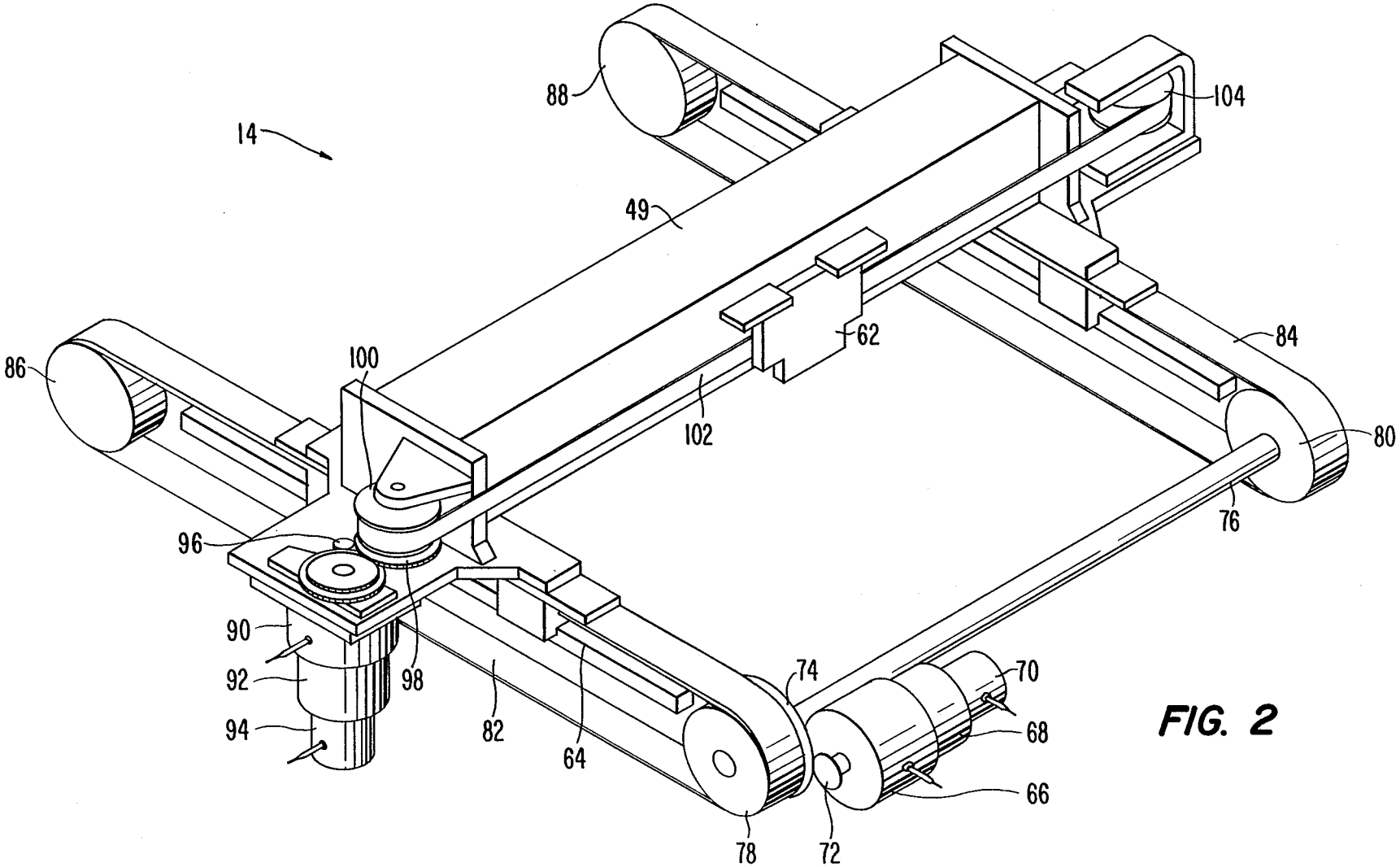
FIG. 2 is a perspective view of the parts of an X-Y carriage assembly used in the machine of the present invention.

The X-Y carriage assembly 14 comprises a carriage means for supporting the cutting tool 106 and is shown in more detail in FIG. 2. The Y carriage for supporting the cutting head assembly 81 is mounted on an X carriage 49 which travels along guide rails 64 extending in a first direction parallel to the feed direction of the sheet material 24. The X carriage extends in a second direction perpendicular to the first direction and is movable back and forth in said first direction by a first drive means and the Y carriage is movably supported on the X carriage 49 for movement in the second direction by a second drive means. The first drive means can comprise a pair of drive pulleys 78, 80 connected by a shaft 76 mounted for rotation on the cutting table, a pair of tension pulleys 86, 88 each of which is aligned with a respective drive pulley and is mounted on the cutting table, a pair of belts 82, 84 supported for rotation on a respective pair of pulleys 78, 86 and 80, 88 with the belts 82, 84 being connected to the X carriage 49 to thereby move the X carriage 49 upon rotation of the drive pulleys 78, 80. The drive pulley 78 is provided with gear teeth 74 which are engaged with a gear 72 mounted on a shaft of an X motor 66. The motor 66 is reversible for operating the first drive means to thereby control movement of the X carriage and the motor 66 is operatively connected to the programmable controller 18 for actuation thereof. Also attached to the motor 66 is a tachometer 68 and a position transducer 70, each of which is operatively connected to the programmable controller 18 for supplying information as to the speed and actual position of the X carriage 49.

The second drive means for driving the Y carriage back and forth in the second direction comprises a drive pulley 100 mounted on one end of the X carriage 49 and a tension pulley 104 mounted on the other end of the X carriage 49, a belt 102 rotatably supported on the pulleys 100, 104 and connected to the Y carriage 62 for moving the Y carriage in the second direction. The drive pulley 100 includes gear teeth 98 thereon which are engaged with a gear 96 mounted on a shaft of a Y motor 90 which is mounted on the X carriage. The motor 90 is reversible and is connected to the programmable controller 18 for actuation thereof. Also connected to the motor 90 is a tachometer 92 and a position transducer 94 which are operatively connected to the programmable controller 18 for supplying information as to the speed and actual position of the Y carriage. The combined movement of the X carriage and the Y carriage allows the cutting tool 106 to follow a cutting path 83 on the sheet material 24.

Figure 3:
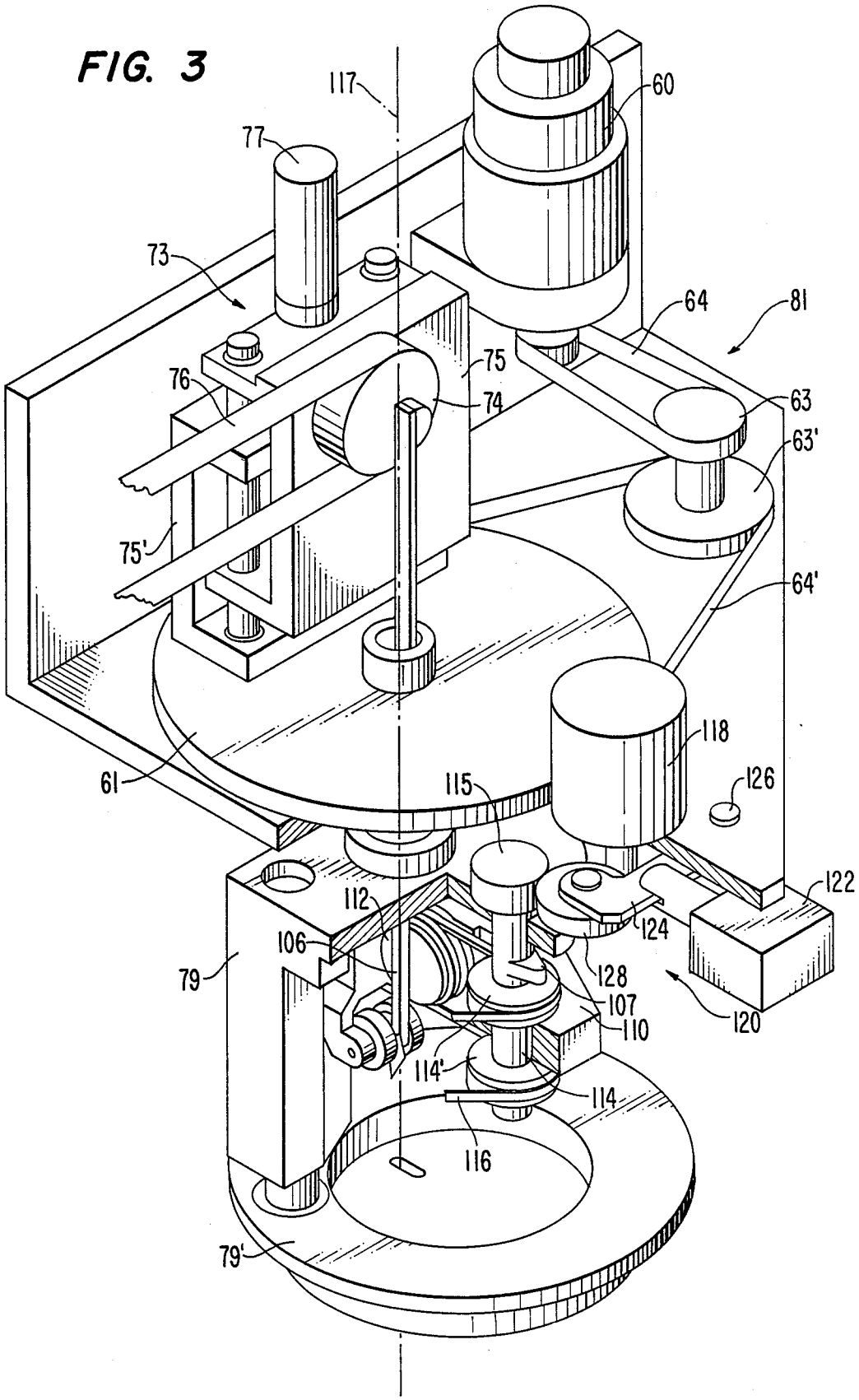
FIG. 3 is a perspective broken away view of a cutting head assembly of the machine according to the present invention.

The cutting head assembly 81 which is mounted on the Y carriage 62, will be described with reference to FIG. 3. The cutting head assembly 81 includes the cutting blade 106 and means 73 for raising and lowering the cutting blade with respect to the cutting surface 20. The cutting head assembly 81 further includes means for rotating the cutting blade about a vertical axis 117 perpendicular to the cutting surface 26 and grinding means for sharpening the cutting blade. The rotating means is operable to rotate the cutting blade from a first angular position at which cutting is performed to a second angular position at which the grinding means is operable to sharpen the cutting blade, the first angular position being variable with respect to axis 117 and the second angular position being fixed with respect to axis 117. The grinding means is operable during a sharpening operation to sharpen one side of the cutting blade for a predetermined period of time and then to sharpen the other side of the cutting blade for another predetermined period of time. The programmable controller means 18 determines when sharpening of the cutting blade is to be performed and the programmable controller means is operatively connected to the raising and lowering means 73 for actuation thereof whereby the cutting blade is raised such that a bottom end thereof is spaced from the cutting surface during the sharpening operation. The programmable controller means 18 is also operably connected to the rotating means for actuation thereof whereby the cutting blade is rotated from the first angular position to the second angular position prior to the sharpening operation. The programmable controller means is further operably connected to the grinding means for actuation thereof during a sharpening operation whereby the grinding means sharpens one side of the cutting blade for a predetermined period of time and then sharpens the other side of the cutting blade for another predetermined period of time after which the programmable controller means actuates the rotating means and the raising and lowering means to return the cutting blade to the first angular position and lower the bottom end thereof, respectively.

In particular, the cutting head assembly 81 is mounted on the Y carriage 62 such that the blade 106 is rotatable about the axis 117 which extends in a direction perpendicular to the cutting surface 26. The cutting blade 106 is mounted on means 73 for raising and lowering the blade with respect to the cutting surface 26 comprising an eccentric mechanism 74 for reciprocating the cutting blade and to which the cutting blade 106 is attached, a movable member 75 supporting the eccentric mechanism 74, a stationary member 75' having vertically extending guide posts for guiding the movable member 75 in a direction parallel to the axis 117, and means for moving the movable member 75 with respect to the cutting surface 26 to thereby raise and lower the cutting blade 106 such that its bottom end can be inserted in the conveyor surface or raised to a position above the conveyor surface, the means for moving the movable member being, for example, a fluid actuated cylinder 77 mounted on the movable member 75 and having an extendible rod connected to the stationary member 75'. The means for raising and lowering the cutting blade is operably connected to the programmable controller 18 so that the cutting blade 106 can be raised when necessary to traverse a portion of the sheet material 24 which is not to be cut or for a sharpening operation. The stationary member 75' is mounted on rotating means for rotating the cutting blade to a desired angular orientation with respect to the axis 117, the rotating means comprising a rotatable support, such as a turntable 61 supported by suitable bearing means on the Y carriage 62 and reversible motor means for rotating the turntable 61. The reversible motor means includes a belt 64' which extends around a circular portion of the turntable 61 and around a pulley 63' mounted on the Y carriage. The pulley 63' is driven by a belt 64 which extends around a pulley 63 coaxially mounted on a shaft connected to the pulley 63' and the belt 64 is driven by a servo-motor 60 mounted on the Y carriage. The servo-motor 60 is operably connected to the programmable controller 18 whereby the belt 64 can be rotated in a clockwise or counter clockwise direction to thereby rotate the turntable 61 whereby a cutting edge 108 of the cutting blade 106 is rotated to a variable first angular position such that it follows a cutting path 83 on the sheet material 24. Also, as will be explained later, the servo-motor 60 is effective for rotating the cutting blade 106 to a fixed second angular position for sharpening thereof. A fabric pressure base 79 is connected to the turntable 61 for rotation therewith and is disposed between the turntable 61 and the cutting surface 26. The fabric pressure base 79 supports a presser foot 79' at an end thereof facing the cutting surface 26. As can be seen in FIG. 3, an elongated hole is provided in the presser foot 79' for passage of the cutting blade 106 therethrough when lowered to a position for cutting pieces from the sheet material 24. The fabric pressure base 79 includes suitable means for guiding the cutting blade 106 and supports elements of the grinding means of the present invention.

The grinding means of the present invention includes a sharpening motor fixedly mounted on the Y carriage of the carriage means, grinder support means pivotally mounted on the turntable 61 of the rotating means, a pair of grinding wheels rotatably supported on the grinder support means, and means for engaging an output shaft of the sharpening motor with the grinder support means and with the grinding wheels such that the grinding support means biases one of the grinding wheels in contact with one side of the cutting blade when the output shaft is rotated in one direction and the grinding support means biases the other one of the grinding wheels in contact with the other side of the cutting blade when the output shaft is rotated in an opposite direction, the engaging means driving the grinding wheels in rotation while biasing the grinder support means. The grinding means will be explained in more detail as follows.

The engaging means includes a shaft 114 mounted on the rotating means, and in particular mounted on the fabric pressure base 79 such that it is rotatable about an axis which is parallel to the axis 117. The shaft 114 pivotally supports grinder support means comprising a V-shaped grinder support 110 which extends in a direction perpendicular to the axis of rotation of the shaft 114. The shaft 114 includes a friction wheel 115 disposed at a top end thereof. The engaging means further comprises a movable friction wheel 128 rotatably mounted on clutch means 120 for engaging the friction wheel 128 with the output shaft of a sharpening motor 118 fixedly mounted on the Y carriage, the friction wheel 128 being further engageable with the friction wheel 115 on the shaft 114. The clutch means is mounted on the Y carriage such that it is operable to engage the friction wheel 128 with the output shaft of the sharpening motor 118 and the shaft 114 only when the cutting blade is in a fixed angular position (the second angular position referred to above) with respect to the axis 117, as will be explained later.

The clutch means 120 comprises an actuator 122 mounted on the Y carriage and a lever 124 having one end thereof pivotally mounted about a shaft 126 attached to the Y carriage. The friction wheel 128 is rotatably mounted on the other end of the lever 124 and the actuator includes an extendible rod connected to the lever 124 for moving the friction wheel 128 into and out of engagement with the output shaft of the sharpening motor 118 and with the shaft 114 when the cutting blade is in the fixed angular position referred to above. The actuator 122 is operably connected to the programmable controller 18 whereby the friction wheel 128 can be brought into engagement with the friction wheel 115 by actuating the actuator 122 such that the extendible rod pushes the lever 124 with the friction wheel 128 towards the friction wheel 115 mounted on the shaft 114. Likewise, the sharpening motor 118 is operably connected to the programmable controller 18 whereby the output shaft of the sharpening motor 118 can be actuated to drive the shaft 114 in a desired direction when the actuator 122 brings the friction wheel 128 into engagement with the output shaft of the sharpening motor 118 and with the friction wheel 115 of the shaft 114.

The shaft 114 includes a pair of pulleys 114' which are spaced apart along the length of the shaft 114. The V-shaped grinder support 110 is pivotally mounted on the shaft 114 between the pulleys 114'. The grinder support 110 includes a pair of arms extending at an angle from a central portion thereof mounted on the shaft 114. The V-shaped grinder support is journaled by suitable means to the shaft 114 such that the shaft 114 can turn freely but will bias the V-shaped grinder support 110 angularly in the direction of rotation of the shaft 114. The pair of arms of the V-shaped grinder support each rotatably support a respective grinder or grinding wheel 112, 112'. The grinders 112, 112' are driven by the engaging means which further comprises a continuous belt 116 which is passed around an annular channel in each of the grinders 112, 112' and around the pair of pulleys 114'. As can be seen in FIG. 3, the belt 116 is passed around the upper pulley 114', then travels horizontally over the grinder 112 which rotates about an axis parallel to the cutting surface 26, then the belt 116 travels horizontally around the lower pulley 114' and over to the lower end of the other grinder 112', upwardly around the outer periphery of the other grinder 112' and then horizontally back to the upper pulley 114'. Thus, by rotation of the friction wheel 115 mounted on the shaft 114, the grinders 112, 112' can be rotated while the V-shaped grinder support 110 biases one of the grinders in contact with one side of the cutting blade 106.

Figure 4:
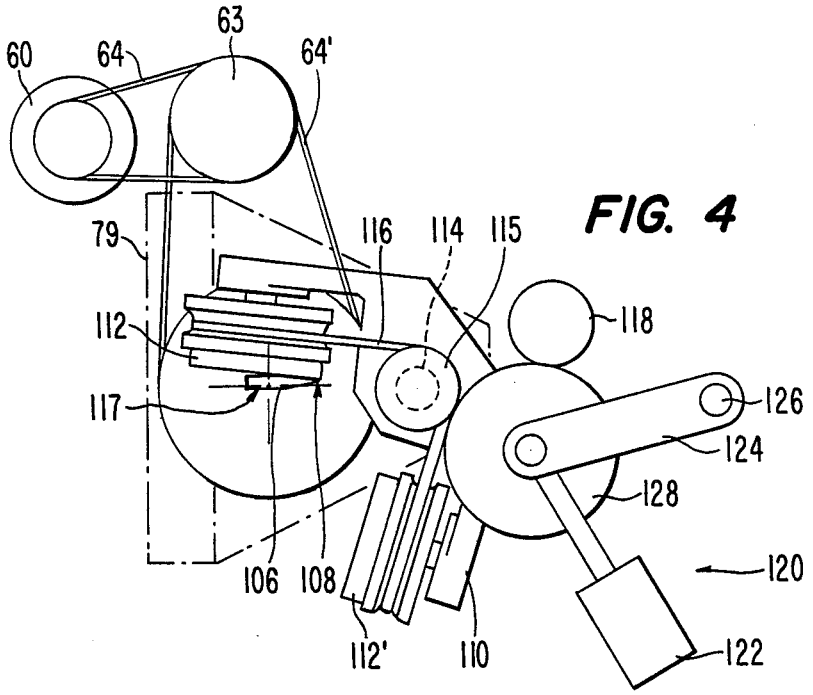
FIG. 4 is a top view of the sharpening mechanism according to the present invention with the cutting blade being shown in a sharpening position.
Figure 5:
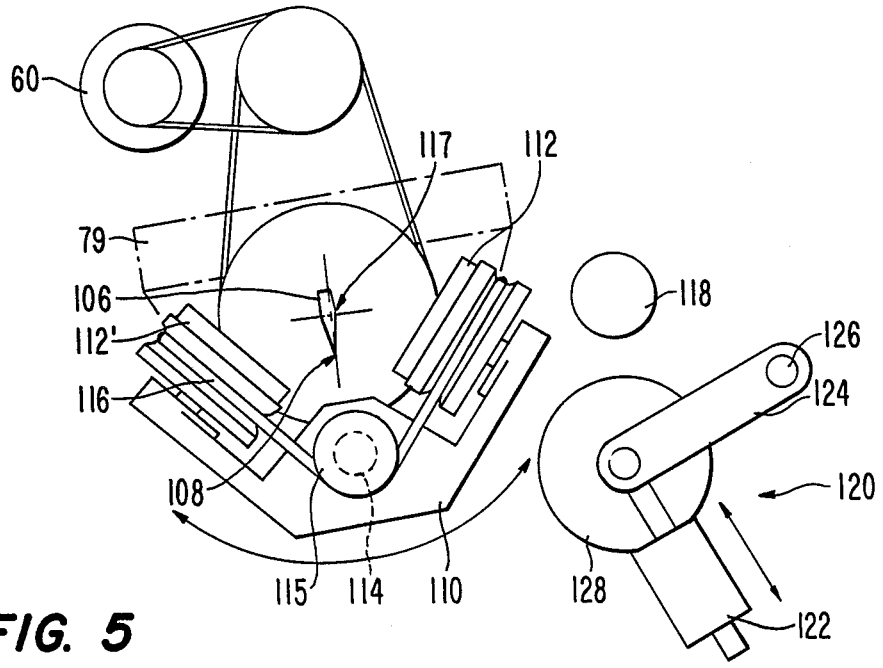
FIG. 5 is a top view of the sharpening mechanism shown in FIG. 4 but with the cutting blade shown in a position at which cutting is performed.

As shown in FIG. 5, the fabric press base 79 is in a first angular position at which the friction wheel 115 is not engageable with the friction wheel 128 even if the actuator 122 is actuated to move the friction wheel 128 in contact with the output shaft of the sharpening motor 118. For a sharpening operation, the fabric press base 79 must be moved from this first angular position to a second angular position as shown in FIG. 4. As can be seen in FIG. 4, when the fabric press base 79 is rotated to the second angular position for a sharpening operation, the friction wheel 128 will engage both the output shaft of the sharpening motor 118 and the friction wheel 115 mounted on the shaft 114. By rotation of the output shaft of the sharpening motor 118 in one direction it is possible to bias one of the grinding wheels 112, 112' such that one side of the cutting edge 108 of the cutting blade is sharpened. To sharpen the other side of the cutting edge 108, the output shaft of the sharpening motor 118 is driven in the opposite direction to thereby bias the V-shaped grinder support such that the other grinding wheel is brought into contact with the cutting blade 106. The method of sharpening the cutting blade 106 will be described as follows.

During a cutting operation, the clutch mechanism 120 remains in the position shown in FIG. 5, so that the turntable 61 can be rotated to maintain the cutting edge 108 of the cutting blade 106 tangent to a desired cutting path 83. The programmable controller 18 determines when a sharpening operation will be conducted. For instance, the programmable controller 18 can compute the allowable cutting distance of the cutting blade between sharpening operations and whether the total cutting distance since the last sharpening operation during cutting of the next piece will exceed the allowable cutting distance. Preferably, the sharpening cycle is performed along a portion of the cutting curve at which the X motor and Y motor are not activated, that is, at a sharp bend or corner in the cutting curve at which only the Z motor (servo-motor 60) is activated. In this way, a sharpening cycle can be avoided along a continuously smooth portion of a cutting curve.

When the programmable controller 18 orders a sharpening operation, the cutting blade is removed from the material by actuating the cylinder 77 to retract its rod and thus move the movable member 75 away from the cutting surface 26 such that the bottom end of the cutting blade 106 is moved above the material 24. Then, the programmable controller 18 actuates the servomotor 60 to rotate the turntable 61 such that the fabric press base 79 is moved from the first angular cutting position (as shown in FIG. 5) to the second angular sharpening position (as shown in FIG. 4). The programmable controller 18 actuates the sharpening motor 118 to rotate the output shaft thereof in a desired direction and the programmable controller 18 also activates the actuator 122 to move the friction wheel 128 in contact with the output shaft of the sharpening motor 118 and the friction wheel 115 mounted on the shaft 114. As a result, the V-shaped grinder support is angularly biased such that one of the grinding wheels 112, 112' contacts one side of the cutting blade 106 for a predetermined length of time after which the direction of rotation of the output shaft of the sharpening motor 118 is reversed to thereby bias the other grinding wheel into contact with the opposite side of the cutting edge 108 of the cutting blade 106. After a predetermined period of time the sharpening operation is terminated and the controller 18 deactivates the sharpening motor 118. Then the controller 18 actuates the motor 60 to rotate the fabric press base 79 to an angular position at which cutting can again be performed, as shown in FIG. 5. As a result of this motion, inertia forces cause the V-shaped grinder support 110 to be positioned such that the grinding wheels 112, 112' are positioned symmetrically with respect to the cutting blade 106, as shown in FIG. 5. A cam 107 is provided on the shaft 114 for engaging a pin (not shown) to prevent the V-shaped grinder support 110 from leaving the position shown in FIG. 5 unless a sharpening operation is performed. When the fabric press base 79 is in its cutting position, as shown in FIG. 5, the cutting operation can be resumed by lowering the cutting blade 106 by actuating the cylinder 77 such that the extendible rod thereof is retracted to thereby lower the movable member 75 and thus lower the eccentric mechanism 74 to which the cutting blade 106 is attached. The eccentric mechanism 74 is rotated by a belt 76 which is driven by suitable means (not shown).

While the invention has been described with reference to the foregoing embodiments, it should be understood that various changes and modifications may be made without departing from the spirit and scope of the invention.

We claim:

1. An apparatus for sharpening a cutting blade of a numerically controlled cutting apparatus, comprising:

means of supporting one or more layers of material to be cut on a cutting surface;

carriage means disposed above said cutting surface for movement across said cutting surface;

a cutting head assembly disposed on said carriage means, said cutting head assembly including a cutting blade and means for raising and lowering said cutting blade with respect to said cutting surface, said cutting head assembly further including means for rotating said cutting blade about an axis perpendicular to said cutting surface and grinding means for sharpening said cutting blade, said rotating means being operable to rotate said cutting blade from a first angular position at which cutting is performed to a second angular position at which said grinding means is operable to sharpen said cutting blade, said first angular position being variable with respect to said axis and said second angular position being fixed with respect to said axis, said grinding means being operable during a sharpening operation to sharpen one side of said cutting blade for a predetermined period of time and then to sharpen the other side of said cutting blade for another predetermined period of time; and programmable controller means for determining when sharpening of said cutting blade is to be performed, said programmable controller means being operatively connected to said raising and lowering means for actuation thereof whereby said cutting blade is raised such that a bottom end thereof is spaced from said cutting surface during said sharpening operation, said programmable controller means being further operably connected to said rotating means for actuation thereof whereby said cutting blade is rotated from said first angular position to said second angular position prior to said sharpening operation, said programmable controller means being further operably connected to said grinding means for actuation thereof during said sharpening operation whereby said grinding means sharpens one side of said cutting blade for a predetermined period of time and then sharpens the other side of said cutting blade for another predetermined period of time after which said programmable controller means actuates said rotating means and said raising and lowering means to return said cutting blade to said first angular position and lower said bottom end thereof, respectively.

2. The apparatus of claim 1, wherein said raising and lowering means comprises a movable member which supports said cutting blade, a stationary member supported by said rotating means and means for moving said movable member with respect to said stationary member.

3. The apparatus of claim 1, wherein said rotating means comprises a rotatable support rotatably supported on said carriage means and reversible motor means for rotating said rotatable support with respect to said carriage means such that said cutting blade is maintained in said first angular position during a cutting operation and in said second angular position during said sharpening operation.

4. The apparatus of claim 3, wherein said rotatable support includes a turntable rotatably supported on said carriage means and a fabric pressure base fixed to said turntable for rotation therewith, said fabric pressure base being disposed between said turntable and said cutting surface, said raising and lowering means being supported on said turntable for rotation therewith.

5. The apparatus of claim 1, wherein said grinding means includes a sharpening motor fixedly mounted on said carriage means, grinder support means pivotally mounted on said rotating means, a pair of grinding wheels rotatably supported on said grinder support means, and means for engaging an output shaft of said sharpening motor with said grinder support means and said grinding wheels such that said grinder support means biases one of said grinding wheels in contact with one side of said cutting blade when said output shaft is rotated in one direction and said grinder support means biases the other one of said grinding wheels in contact with the other side of said cutting blade when said output shaft is rotated in an opposite direction, said engaging means driving said grinding wheels in rotation with biasing said grinder support means.

6. The apparatus of claim 5, wherein said engaging means comprises a shaft rotatably supported on said rotating means, said shaft pivotally supporting said grinder support means and biasing said grinder support means when said shaft is rotated, said engaging means further comprising a movable friction wheel rotatably mounted on clutch means for engaging said friction wheel with said output shaft of said sharpening motor and said shaft supporting said grinder support means, said clutch means being mounted on said carriage means and operable to engage said friction wheel with said output shaft and said shaft only when said cutting blade is in said second angular position.

7. The apparatus of claim 4, wherein said engaging means further includes belt means extending between said grinding wheels and said shaft whereby rotation of said shaft effects rotation of said grinding wheels.

8. The apparatus of claim 7, wherein said belt means comprises a single endless belt extending around a circumferential annular groove in each of said grinding wheels and around spaced apart pulleys disposed on said shaft.

9. The apparatus of claim 4, wherein said rotatable support includes a turntable rotatably supported on said carriage means and a fabric pressure base fixed to said turntable for rotation therewith, said fabric pressure base being disposed between said turntable and said cutting surface, said raising and lowering means being supported on said turntable for rotation therewith.

10. The apparatus of claim 4, wherein said clutch means comprises a actuator mounted on said carriage means and a lever having one end thereof pivotally mounted on said carriage means, said friction wheel being rotatably mounted on the other end of said lever, and said actuator including an extendible rod connected to said lever for moving said friction wheel into and out of engagement with said output shaft of said sharpening motor and with said shaft supporting said grinder support means when said cutting blade is in said second angular position.

11. An apparatus for sharpening a cutting blade of a numerically controlled cutting apparatus, comprising:

means for supporting one or more layers of material to be cut on a cutting surface;

carriage means disposed above said cutting surface for movement across said cutting surface;

a cutting head assembly disposed on said carriage means, said cutting head assembly including a cutting blade and means for raising and lowering said cutting blade with respect to said cutting surface, said cutting head assembly further including means for rotating said cutting blade about an axis perpendicular to said cutting surface and grinding means for sharpening said cutting blade, said rotating means being operable to rotate said cutting blade from a first angular position at which cutting is performed to a second angular position at which said grinding means is operable to sharpen said cutting blade, said first angular position being variable with respect to said axis and said second angular position being fixed with respect to said axis, said grinding means being operable during a sharpening operation to sharpen one side of said cutting blade for a predetermined period of time and then to sharpen the other side of said cutting blade for another predetermined period of time, said grinding means including a sharpening motor fixedly mounted on said carriage means, grinder support means pivotally mounted on said rotating means, a pair of grinding wheels rotatably supported on said grinder support means, and means for engaging an output shaft of said sharpening motor with said grinder support means and said grinding wheels such that said grinder support means biases one of said grinding wheels in contact with one side of said cutting blade when said output shaft is rotated in one direction and said grinder support means biases the other one of said grinding wheels in contact with the other side of said cutting blade when said output shaft is rotated in an opposite direction, said engaging means driving said grinding wheels in rotation while biasing said grinder support means, said engaging means comprising a shaft rotatably supported on said rotating means, said shaft pivotally supporting said grinder support means and biasing said grinder support means upon rotation of said shaft, said engaging means further including belt means extending between said grinding wheels and said shaft whereby rotation of said shaft effects rotation of said grinding wheels; and programmable controller means for determining when sharpening of said cutting blade is to be performed, said programmable controller means being operatively connected to said raising and lowering means for actuation thereof whereby said cutting blade is raised such that a bottom end thereof is spaced from said cutting surface during said sharpening operation, said programmable controller means being further operably connected to said rotating means for actuation thereof whereby said cutting blade is rotated from said first angular position to said second angular position prior to said sharpening operation, said programmable controller means being further operably connected to said grinding means for actuation thereof during said sharpening operation whereby said grinding means sharpens one side of said cutting blade for a predetermined period of time and then sharpens the other side of said cutting blade for another predetermined period of time after which said programmable controller means actuates said rotating means and said raising and lowering means to return said cutting blade to said first angular position and lower said bottom end thereof, respectively.

12. The apparatus of claim 11, wherein said raising and lowering means comprises a movable member which supports said cutting blade, a stationary member supported by said rotating means and means for moving said movable member with respect to said stationary member and said rotating means comprises a rotatable support rotatably supported on said carriage means and reversible motor means for rotating said rotatable support with respect to said carriage means such that said cutting blade is maintained in said first angular position during a cutting operation and in said second angular position during said sharpening operation.

13. The apparatus of claim 11, wherein said engaging means further comprises a movable friction wheel rotatably mounted on clutch means for engaging said friction wheel with said output shaft of said sharpening motor and said shaft supporting said grinder support means, said clutch means being mounted on said carriage means and operable to engage said friction wheel with said output shaft and said shaft only when said cutting blade is in said second angular position.

14. The apparatus of claim 11, wherein said belt means comprises a single endless belt extending around a circumferential annular groove in each of said grinding wheels and around spaced apart pulleys disposed on said shaft and said clutch means comprises an actuator mounted on said carriage means and a lever having one end thereof pivotally mounted on said carriage means, said friction wheel being rotatably mounted on the other end of said lever, and said actuator including an extendible rod connected to said lever for moving said friction wheel into and out of engagement with said output shaft of said sharpening motor and with said shaft supporting said grinder support means when said cutting blade is in said second angular position.

15. The apparatus of claim 11, further comprising detection means associated with said grinder support means for signaling said programmable controller means when said grinding support means is angularly positioned on said shaft such that said grinding wheels are spaced from said cutting blade and said rotatable support includes a turntable rotatably supported on said carriage means and a fabric pressure base fixed to said turntable for rotation therewith, said fabric pressure base being disposed between said turntable and said cutting surface, said raising and lowering means being supported on said turntable for rotation therewlth.

16. A method of sharpening a cutting blade of a numerically controlled cutting apparatus comprising:

raising said cutting blade such that a bottom end thereof is spaced above a cutting surface;

rotating said cutting blade about an axis perpendicular to said cutting surface from a first angular position at which cutting is performed, to a second angular position at which sharpening is performed, said first angular position being variable with respect to said axis and said second angular position being fixed with respect to said axis;

sharpening said cutting blade by actuating grinding means to first sharpen one side of said cutting blade for a predetermined period of time and then to sharpen the other side of said cutting blade for another predetermined period of time; and rotating said cutting blade from said second angular position to said first angular position; and lowering said blade to begin a cutting operation.

17. The method of claim 16, wherein said rotating is performed by actuating a reversible motor connected to a rotatable support on which said cutting blade is mounted to thereby selectively rotate said cutting blade to first angular position and said second angular position.

18. The method of claim 17, wherein said raising and lowering is performed by actuating a fluid actuated cylinder connected between a movable member supporting said cutting blade and a stationary member supported on said rotatable support to thereby raise and lower said cutting blade.

19. The method of claim 16, wherein said sharpening is performed by actuating a sharpening motor and actuating an actuator to move a friction wheel into engagement with an output shaft of said sharpening motor and with a shaft, said shaft being in driving engagement with a pair of grinding wheels rotatably mounted on a pivotable grinder support, said sharpening motor driving said grinding wheels and biasing said grinder support such that one of said grinding wheels sharpens one side of said cutting blade when said output shaft of said sharpening motor is driven in one direction and said sharpening motor driving said grinding wheels and biasing said grinding support such that the other one of said grinding wheels sharpens the other side of said cutting blade when said output shaft of said sharpening motor is driven in the opposite direction.

20. The method of claim 16, wherein said sharpening is performed by actuating a sharpening motor and by actuating means to engage said sharpening motor with said grinding means, said means for engaging said sharpening motor with said grinding means being operable only when said cutting blade is in said second angular position.

* * * * *